US006332026B1

(12) United States Patent
Kuusama et al.

(10) Patent No.: US 6,332,026 B1
(45) Date of Patent: Dec. 18, 2001

(54) BASS MANAGEMENT SYSTEM FOR HOME THEATER EQUIPMENT

(75) Inventors: Juha Kuusama; Minna Juhola; Juha Laaksonen, all of Tampere (FI)

(73) Assignee: Flextronics Design Finland Oy, Tampere (FI)

( * ) Notice: Subject to any disclaimer, the term of this patent is extended or adjusted under 35 U.S.C. 154(b) by 0 days.

(21) Appl. No.: 09/043,681

(22) PCT Filed: Aug. 5, 1997

(86) PCT No.: PCT/FI97/00466

§ 371 Date: May 1, 1998

§ 102(e) Date: May 1, 1998

(87) PCT Pub. No.: WO98/06239

PCT Pub. Date: Feb. 12, 1998

(30) Foreign Application Priority Data

Aug. 6, 1996 (FI) ..... 963104
May 26, 1997 (FI) ..... 972221

(51) Int. Cl.[7] ..... H04R 5/00
(52) U.S. Cl. ..... 381/17; 381/104; 381/307
(58) Field of Search ..... 381/18, 19, 20, 381/27, 104, 307

(56) References Cited

U.S. PATENT DOCUMENTS 5,200,709 * 4/1993 Saito et al. ..... 330/126
5,257,313 * 10/1993 Fujishita et al. ..... 381/18
5,459,790 * 10/1995 Scofield et al. ..... 381/25
5,680,464 * 10/1997 Iwamatsu ..... 381/18
5,748,746 * 5/1998 Ozaki et al. ..... 381/18
5,970,152 * 10/1999 Klayman ..... 381/1
6,009,179 * 12/1999 Wood et al. ..... 381/17
6,122,382 * 9/2000 Iida et al. ..... 381/18

FOREIGN PATENT DOCUMENTS 0 546 619 A2 6/1993 (EP) .
0 729 287 A2 8/1996 (EP) .

* cited by examiner

*Primary Examiner*—Xu Mei
*Assistant Examiner*—Brian Tyrone Pendleton
(74) *Attorney, Agent, or Firm*—Burns, Doane, Swecker & Mathis, L.L.P.

(57) ABSTRACT

A setup to be used in a home theater or sound reproduction system for handling low frequency sound signals with a signal source providing several full bandwidth digital sound channels and at least one digital low frequency subwoofer channel includes a delay-and level control unit at least for each full bandwidth signal channel, which is equipped for a speaker not capable of reproducing low frequency sounds. A first summing stage creates the sum channel by summing the delay-and level controlled signal channels. A second summing stage adds a low frequency subwoofer channel to the sum channel in order to create a digital bass channel. A DA-conversion, amplifying, lowpass-filtering and volume control unit processes the digital bass channel in order to create an analog bass channel.

2 Claims, 2 Drawing Sheets

1/2

100
101
102
103
107
Analog signal source selector
1
2
n
109
A/D converter
111
Signal source selector
112
PROCESSING UNIT
113
DA CONVER-SION
114
BASS MANAGE-MENT
115
116
117
118
119
120
104
105
106
108
Digital signal source selector
110
Digital audio receiver Complementary filters
Variable gains 207
201
high
low
212
213
208
202
214
215
209
203
216
217
210
204
218
219
211
205
220
221
206
222
223
224

BASS MANAGEMENT SYSTEM FOR HOME THEATER EQUIPMENT

BACKGROUND OF THE INVENTION

1. Field of the Invention

The innovation is a setup in home theater or other sound reproduction equipment to be used for handling low frequency audio signals with an audio signal source producing several digital full bandwidth audio channels and possibly in addition to these one or several digital low frequency sub-woofer channels.

2. Description of the Related Art

As laserdisc players and hifi-VCR's have grown popular, also the so called home theater setups have become widespread, especially in USA. Such a setup typically includes a large screen television, laserdisc player and/or VCR and a sound reproduction system consisting of surround sound decoder, multi-channel audio amplifier and speakers. In addition to the usual two main front speakers there is a center speaker between them, one or two surround speakers situated behind or on sides of the listeners and possibly also a separate subwoofer speaker for reproduction of low bass signals.

A simplified block diagram of a home theater setup is presented in FIG. 1. For the sake of clarity, user and control interfaces, volume control (placed either in digital domain in conjunction with DA-converters or after the bass management) and power amplifiers have been left out of the figure. The setup in FIG. 1 consists of input stage 100, into which both several analog inputs 101, 102, 103 and several digital inputs 104, 105, 106 may be connected. In each case the input signal is selected with signal source selectors 107 and 108, respectively for analog and digital input sources. After this the analog input signal is AD-converted with AD-converter 109 and digital input signal is handled with digital audio receiver 110. From these two digital signals one is selected with source selector 111, followed by the processor unit 112 which will perform the desired processing to the digital audio signal. This processing may include such steps as Dolby Digital (previously Dolby AC-3) decoding, Dolby Pro Logic decoding, THX post processing, room simulations, tone controls etc. After these processing steps these typically six digital audio signals are DA-converted. The number of channels varies between different systems; for instance there may be from 1 up to 4 or 6 surround channels and also there may be more than one center channels. After the DA-conversion there has to be the so called bass management in block 114, to avoid feeding strong bass signals to speakers unable to handle them. As a result, output signals for left front speaker, center speaker, right front speaker, left surround speaker, right surround speaker and subwoofer are generated. These outputs are labelled 115–120 in FIG. 1.

Let us note, that in this context the word speaker refers to a typically enclosed entity consisting of one or several speaker elements. "Large or full range speaker" refers to a speaker capable of reproducing at least most of the audio bandwidth, ie. both low bass signals and high treble sounds. "Small tweeter speaker" refers to a speaker which is only able to reproduce high frequencies and no low bass signals.

There is also low bass material in movie soundtracks. In many cases it is not practical to have six large speakers in a home theater setup. An example of a more practical solution is to have large front main speakers whereas the other speakers are small. Small speakers can not reproduce low frequency signals; high level low frequency signals may even damage these speakers. One of the functions of a home theater device is therefore to extract low bass signals from small speaker output signals and to redirect them to large speakers capable of reproducing them. This function is called bass management (block 114 in FIG. 1).

In most home theater devices bass management is realized with analog filters and switches. This approach is very straight forward to build and is directly compatible with eg. the Dolby configuration definitions. Disadvantages of this approach are the limited flexibility resulting from fixed switches and unclarity from the user's point of view. Therefore most home theater devices can only perform configurations 1 and 2 of the Dolby license definitions, some of them configuration 3 as well. The user can not choose freely from all possible combinations of large and small speakers and also the user has to know and understand the meaning of Dolby configurations 1, 2 and 3 (Dolby AC-3 licensee information manual, version 1.0, figures 9.6, 9.7 and 9.8; all blocks are analog).

The limitations of analog bass management are easy to overcome by carrying out the necessary filtering and summing in digital domain. In this case the user interface for defining the speaker configuration is intuitively: "Front Main: large/small, Center: large/small/none, Surrounds: large/small/none, Subwoofer: yes/no". Now at its best the bass management for one channel may be performed as described in FIG. 2. This entity described in FIG. 2 is unlikely to have been presented before and is placed for each channel in the processing unit 112 in FIG. 1. The result is that the processing unit is only followed by a six-channel DA-converter 113 while bass management unit 114 is left out as obsolete.

In FIG. 2 the incoming digital signals for left front speaker, center speaker, right front speaker, left surround speaker, right surround speaker and subwoofer speaker have been marked 201–206. These signals are fed to complementary filters 207–211, which divide the incoming signals to "high" and "low " output signals, some of which equals the incoming signal except for slight processing delay. These ten output signals as well as the subwoofer output signal are driven through adjustable amplifying stages 212–222 to summing stage 223 to generate output signal 224 for one speaker. With summing stages 212–222 the output signal for each speaker may be flexibly set as combination of full bandwidth input signals.

Controlled by speaker configuration switches a large speaker gets both "high " and "low" outputs. A small speaker only gets "high" output signals, which lack the low bass sounds. These will be directed to large speakers. Also leaving a speaker completely off the design is possible. In this case the signal of eg. missing center speaker may be divided between the two main front speakers. Also when bass sounds are divided to several speakers for reproduction (eg. configuration with several large speakers but no subwoofer) the correct level for bass sounds can be set.

The benefits of this approach also include perfect control of processing delays and thus the signal delays experienced by the listener, and the fact that the sound field may be controlled by peculiar ways eg. by shifting it 90 or 180 degrees.

In practice some summing coefficients are always zero eg. right channel signals are never redirected to left channel, and subwoofer never gets any high sounds. To save processing power the system described in FIG. 2 needs not to be implemented completely. It may also be carried out with appropriate combinations of ordinary non-complementary filters in which the signal is suitably fed, even if the processing block diagram would be substantially different from the one described above.

Even though digital bass management has many benefits it also has its drawbacks especially when using Dolby AC-3 system (also known as Dolby Digital). This system includes a separate subwoofer channel which by definition is to be reproduced ten desibels (10 dB=3.16) louder than the other channels. Since the dynamic range of DA-converters is limited the sound quality may then deteriorate. Let us assume for example a speaker configuration with large main front speakers, small other speakers and no subwoofer speaker in a situation in which the incoming signal has full amplitude bass sound in every channel. If reference level for full amplitude signal is said to be 1 then the summed bass signal level of surround speakers is 2, center channel bass signal level is 1 and subwoofer channel signal level is 3.16, and the summed redirected bass signal level is thus 3.16+2+1=6.16. When this is divided equally to left and right main front speakers the signal level of these channels becomes 1+(6.16/2)=4.08=4.08=+12.2 dB. In order to avoid overdriving the DA-converters under any circumstances the signal level has to be reduced 12.2 desibels before DA-converters. The worst case is a speaker configuration with no subwoofer and in which only the center channel is large resulting in a need to reduce the signal level by 18.2 dB. This leads to deterioration of sound quality.

The 18 or 20 bit DA-converters currently widely in use have dynamic range of about 85–95 dB. When signal level is dropped before DA-converters their limited dynamic range is not fully exploited (12–18 dB equals 2–3 bits).

It is also inconvenient for the user if the output signal level varies substantially between different speaker configurations. For instance determining correct amplifying power and sensitivity is almost impossible.

SUMMARY OF THE INVENTION

The purpose of the present invention is to present a bass management setup which combines the benefits of both setups described earlier. This is achieved by a setup according to the present invention the first embodiment of which is characterized by comprising a delay and level control unit for at least every full bandwidth signal channel equipped with a speaker unable to reproduce low pitch sounds;

a first summing stage for summing the delay and level controlled signal channels to create a sum channel;

a second summing stage for summing the low frequency subwoofer channel into the sum channel to create a digital bass channel and a DA-converter-, amplifying-low-pass filtering- and volume control unit to perform these functions to the digital bass channel in order to create an analog bass channel.

The second embodiment of the invention is characterized by comprising a delay and level control unit for at least every full bandwidth signal channel equipped with a speaker unable to reproduce low pitch sounds;

a first summing stage for summing the delay and level controlled signal channels to create a sum channel a low pass filter for the sum channel a second summing stage to sum the low frequency subwoofer channel to the low frequency filtered sum channel to create a digital bass channel and a DA-converter-, amplifying- and volume control unit to perform these functions to the digital bass channel in order to create an analog bass channel.

Best features of the previously described bass management methods may be combined with a setup in which all necessary filters and delays are done digitally but signal summing at least mostly in,analog domain. By doing this the flexibility of a digital system is maintained and the dynamic range of DA-converters can be fully exploited.

Economically the setup complying with this innovation also includes either switching and summing stages or adjustable volume control and summing stages to combine the analog bass channel to the analog signals going to speakers which are able to reproduce full bandwidth sound signals.

BRIEF DESCRIPTION OF THE DRAWINGS

In the following this innovation is presented in more detail with reference to the accompanying drawing in which.

DETAILED DESCRIPTION OF THE INVENTION

Figure 1:
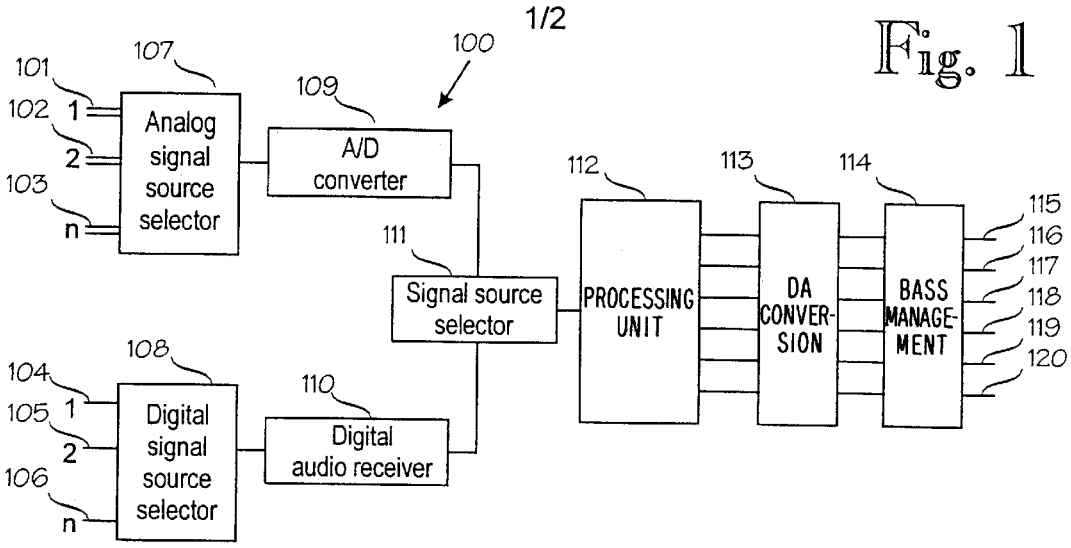
FIG. 1 shows a simplified block diagram of a traditional home theater setup.
Figure 2:
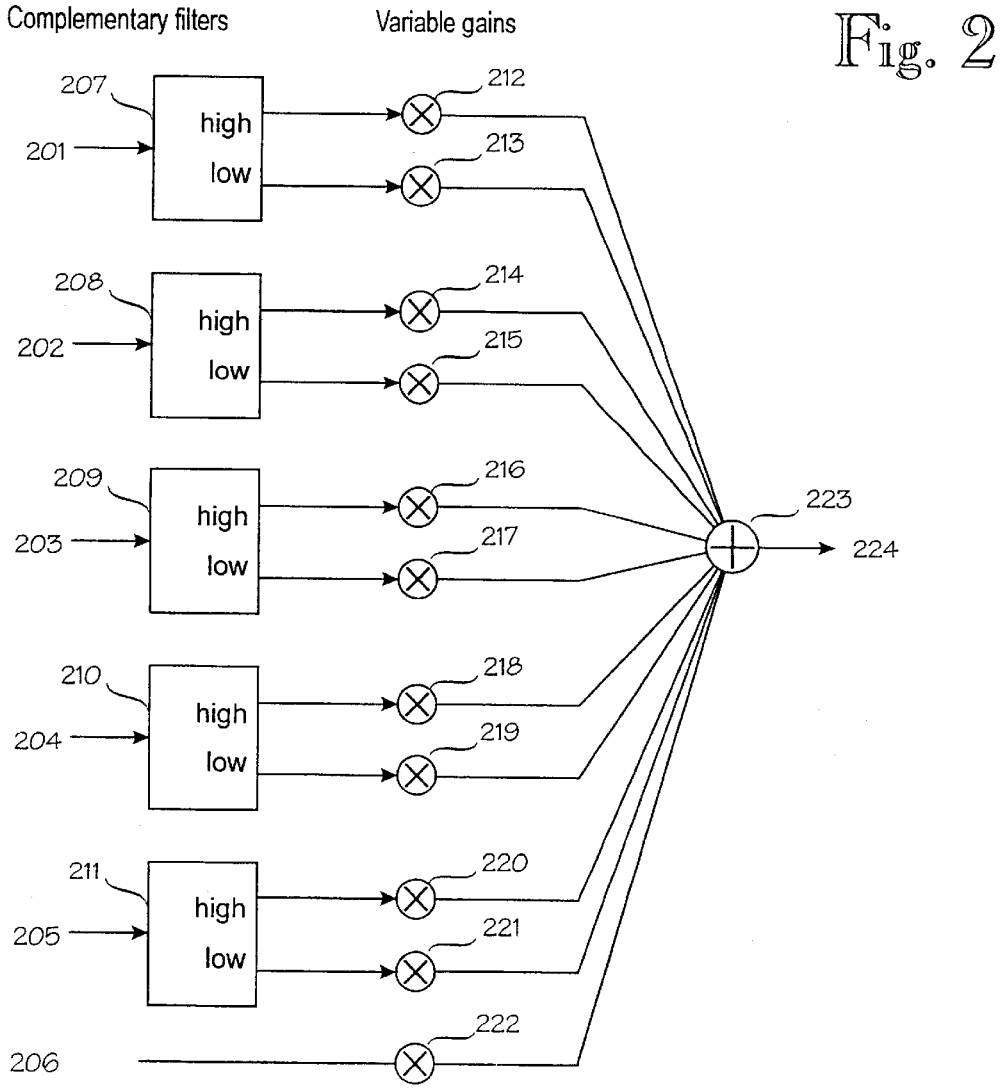
FIG. 2 shows the block diagram of digital bass management in principal, and FIG. 3 describes the setup according to the invention for bass management in home theater setup as a block diagram. Also the interfacing of the bass channel to one other channel is presented, in this case the left front channel. The signal redirection has been left out from this figure to maintain clarity.
Figure 3:
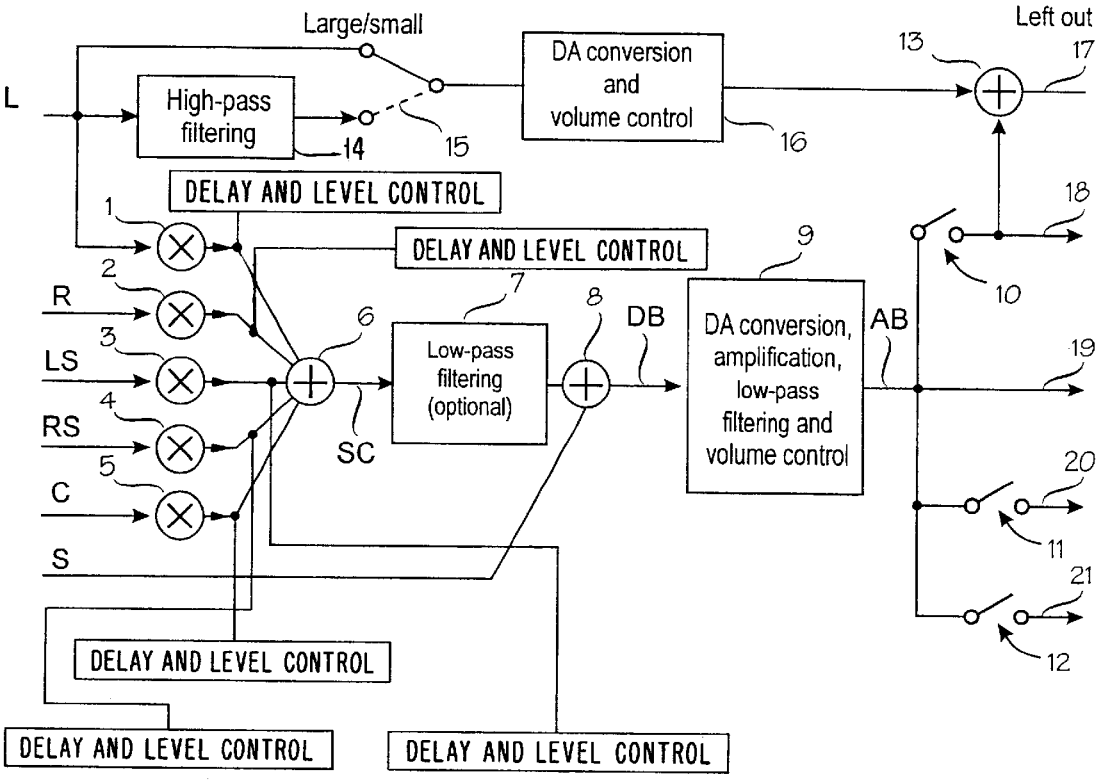

Inputs for this setup are the digital sound signals divided in the following six channels: left front channel L, right front channel R, left surround channel LS, right surround channel RS, center channel C and subwoofer channel S. These signal inputs may be generated for example in block 112 in FIG. 1 and they comply with the signals in use for example in Dolby Digital (Dolby AC-3 ) system. In FIG. 3 the left front channel L has been presented completely. It consists of a high-pass filter 14 through which the signal goes if the front speakers are small, before the signal is fed to switch 15. Equal building blocks (not presented) also exist for right and center channels as well as both surround channels. If any specific speaker is small, the low bass frequencies are taken away from its signal by high-pass filtering. If however a speaker is large the signal is neither high-pass filtered nor summed to the bass channel to be described in more detail later, but instead the high-pass-filter 14 is bypassed and the signal fed directly to switch 15 directing the signal to summing stage 13 through DA-converter and volume control unit 16. In summing stage 13 the bass channel is summed to this signal in order to create the signal directed to this specific large speaker.

In order to create the bass management in a setup according to the invention a bass channel is created from the signals of those channels in which the speakers are small and the subwoofer channel S. In the setup presented in FIG. 1 any of the channels L, R. LS, RS and C can be withdrawn the bass channel. In this setup the level balance between the signals and delays is first adjusted in a delay-and level control unit 1 . . . 5 respectively. After this the signals are summed in a summing stage 6 to create the sum channel SC. Also in this setup the signals from large speakers are not added in the sum channel by setting their amplification to zero in the delay-and level control unit. Subwoofer channel S signal is then added to the summed and possibly low pass-filtered (7) signal creating the digital bass channel signal DB. This signal is processed in DA-converter-, amplification-, low pass-filtering- and volume control unit 9 to create analog bass channel AB. This signal is directed primarily to subwoofer channel 19 if there is a subwoofer in the system. If there is no subwoofer the signal is directed to large speakers. One low passfilter is enough for the bass channel signal and it can be done either digitally in unit 7 or in analog domain in unit 9, ie. either before DA-conversion or after it.

When analog bass channel is directed to large speakers instead of the missing subwoofer speakers, switches 10, 11 and 12 of FIG. 3 are used to direct the bass channel for summing in left and right front channel 17 and 18, surround channel 20 or center channel 21 depending on which speakers of these are large. Summing is done in summing stages of which only the left front channel summing stage 13 is presented. It is possible for left and right front channel as well as left and right surround channel speakers to be different from each other, ie. one small and one large, but this deteriorates the sound quality. In this case, however, the number of switches 10 and 11 has to be doubled, one for each front speaker and one for each surround speaker, respectively.

Let us note that the analog switches 10, 11 and 12 can be replaced by a volume control. In this case no attenuation/level control is needed in digital summing stage since the bass channel level control is done in this volume control. Also, in this case the dynamic range of the bass channel DA-converter is always fully exploited.

The benefits of the setup complying with this innovation are:

Only a minor amount of processing power is required, maximum 5 high pass-filters and 1 low pass-filter. And the lowpass-filter can be performed in analog domain if required.

There is allways full amplitude signal in DA-converters except in the bass channel taking advantage of all available dynamic range. Even if the bass signal of some individual channels in some cases has to be attenuated the sound quality is not deteriorated because the noise spectrum of the noise generated in a DA-comverter is spread to the whole audio band. Since in any case only the low frequencies are required from the signal in the bass channel DA-converter most of the signal spectrum and therefore also most of the noise may be lowpass-filtered after DA-conversion.

The flexibility of digital setup is maintained.

The method for handling different channel signals in a setup complying with this invention may be summarized in the following bass management philosophy.

1: If a speaker is large nothing is done to the signal.

2: If a speaker is small the signal is high-pass-filtered and simultaneously summed to the subwoofer signal with amplitude depending on speaker configuration to create a bass channel. Bass channel is lowpass-filtered. If there is a subwoofer speaker in the system the bass channel is directed to it. If there is no subwoofer speaker the bass channel is summed to the signals directed to large speakers.

The setup complying with this innovation is above described with only one explanatory example and it is therefore understandable that it may be altered in various ways based on the bass management philosophy without, however, differeing from the scope of the protection defined in the attached patent claims.

What is claimed is:

1. A setup to be used in a home theater or other sound reproduction system for handling low frequency sound signals, comprising:

a signal source providing several full bandwidth digital sound channels;

at least one digital low frequency subwoofer channel;

a delay-and level control unit at least for each full bandwidth signal channel, which is equipped with a speaker not capable of reproducing low frequency sounds;

a first summing stage for creating a sum channel by summing the delay-and level controlled signal channels;

a second summing stage to add the low frequency subwoofer channel to the sum channel in order to create one digital bass channel;

a DA-conversion-, amplifying-, lowpass-filtering-and volume control unit to process the digital bass channel in order to create an analog bass channel; and switch means disposed between speakers capable of reproducing full bandwidth sound signals and the analog bass channel, and summing means for combining the analog bass channel to analog signals directed to speakers capable of reproducing full bandwidth sound signals.

2. A setup to be used in a home theater or other sound reproduction system for handling low frequency sound signals, comprising:

a signal source providing several full bandwidth digital sound channels;

at least one digital low frequency subwoofer channel;

a delay-and level control unit at least for each full bandwidth signal channel, which is equipped with a speaker not capable of reproducing low frequency sounds;

a first summing stage for creating a sum channel by summing the delay-and level controlled signal channels;

a second summing stage to add the low frequency subwoofer channel to the sum channel in order to create one digital bass channel;

a DA-conversion-, amplifying-, lowpass-filtering-and volume control unit to process the digital bass channel in order to create an analog bass channel; and adjustable volume control means disposed between speakers capable of reproducing full bandwidth sound signals and the analog bass channel, and summing means for combining the analog bass channel to analog signals directed to speakers capable of reproducing full bandwidth sound signals.

* * * * *